United States Patent [19]

Johansson et al.

[11] 4,252,279

[45] Feb. 24, 1981

[54] METHOD FOR DRY-DEFIBRATION OF CHEMICAL, CHEMI-MECHANICAL AND MECHANICAL FIBER PULP OR MIXTURES THEREOF

[75] Inventors: Stig G. Johansson, Kil; Sverker R. F. Y. Björck, Braås, both of Sweden

[73] Assignee: Sodra Skogsagarna AB, Vaxjo, Sweden

[21] Appl. No.: 965,064

[22] Filed: Nov. 30, 1978

[30] Foreign Application Priority Data

Dec. 9, 1977 [SE] Sweden ..... 7714021
May 30, 1978 [SE] Sweden ..... 7806233

[51] Int. Cl.[3] ..... B02C 13/286

[52] U.S. Cl. ..... 241/27; 241/28; 241/30

[58] Field of Search ..... 270/39; 226/118, 74; 271/145; 241/27, 28, 30, 189 A, 189 R, 186 R, 190

[56] References Cited

U.S. PATENT DOCUMENTS

| | | | |
|---|---|---|---|
| 1,851,390 | 3/1932 | Kehoe | 241/30 |
| 3,631,972 | 1/1972 | Gendron et al. | 270/39 X |
| 3,738,580 | 6/1973 | Harris | 241/30 |

FOREIGN PATENT DOCUMENTS

| | | | |
|---|---|---|---|
| 429422 | 7/1967 | Fed. Rep. of Germany | 241/30 |
| 979069 | 4/1902 | France | 241/30 |
| 222271 | 9/1968 | Sweden | 241/30 |
| 395733 | 2/1973 | Sweden | 241/30 |

*Primary Examiner*—Mark Rosenbaum
*Attorney, Agent, or Firm*—Young & Thompson

[57] ABSTRACT

An improved method and means for dry defibrating fiber material in the form of chemical, chemi-mechanical or mechanical fiber pulp or mixtures thereof by means of known defibration devices, so-called shredders, mills or similar devices, to obtain fluff, i.e. exposed, unbonded fibers and fiber flocks used in a manner known per se to make paper, paper-like and absorbent products, by which method said fiber material is fed to the defibration device in the form of a continuous web from a bale being said means and consisting of a pressed or non-pressed zig-zag-shaped, repeatedly folded continuous web.

6 Claims, 10 Drawing Figures

METHOD FOR DRY-DEFIBRATION OF CHEMICAL, CHEMI-MECHANICAL AND MECHANICAL FIBER PULP OR MIXTURES THEREOF

The present invention relates to a method for dry defibration of fiber material in the form of chemical, chemi-mechanical or mechanical fiber pulp or mixtures thereof by means of known defibration devices, so-called shredders, mills or similar devices, to obtain fluff, i.e. exposed fibers and fiber flocks used in a manner known per se to make paper, paper-like and absorbent products. The new process is characterized in that the fiber material which is to be defibrated into free, i.e. separate, fibers and fiber bundles, are fed to a defibration device in the form of a continuous fiber web from a bale consisting of a pressed or non-pressed zig-zag shaped repeatedly folded continuous web.

In making products which include dry defibrated pulp fibers from chemical, chemi-mechanical or mechanical fiber pulp (especially in the manufacture of baby diapers and sanitary napkins as well as various highly absorbent hospital articles) one starts with so-called fluff pulp. This fluff pulp must be defibrated into so-called fluff, which is the absorbent layer in a diaper, sanitary napkin or the like, and for this a defibrator device (shredder) is used which can vary somewhat in design and operation depending on in what form the dry pulp is fed into the defibration device. According to present known technology, the dry pulp (fluff pulp) can be delivered in the following forms:

1. roll, consisting of a continuous fiber pulp web
2. sheet
3. bale

The shredders, as was mentioned above, have different designs, according to their capabilities of handling one of the three types of pulp above. The shredders also work according to different principles of defibration and can, for example, be constructed as hammer mills or as rotating means with needles or saw teeth, or as pin mills, or disc refiners, or guillotines etc. Such defibration or disintegration devices, which according to recent technology have even begun to be used for dry defibration of fiber pulp for use in the production of paper or paper products, are, as was mentioned, known per se and have been described in the literature. For example, known devices have been described in Swiss Pat. No. 429,422, U.S. Pat. No. 1,851,390 and Swedish Lay-open Print 7401869-8. The last-mentioned specification states on the bottom of page 2 that factories which use cellulose for the production of fluff, "for example for use in sanitary napkins or disposable diapers . . . can today use only cellulose in sheet or roll form, which is shredded in a sheet shredder or a so-called fluffer". Other defibration devices which have had great practical importance in many countries include, for example, the defibration devices manufactured by the Swedish company MoDo Mekan AB which works with baled pulp, and the Kamas B-fluffer device manufactured by the Swedish company Kamas Industri AB, which makes fluff from mechanical flake dried pulp in blocks, and in parallel therewith from chemical pulp in roll form, with variable proportions of each type of pulp from 0 to 100%. We will return to this defibration device in the examples below. The defibration device (shredder) and the subsequent diaper machine can be more or less integrated according to different systems. Since both of the machines are known per se and do not belong to the present invention, they will not be described in detail here, except when necessary for understanding of the examples.

To provide the necessary background for understanding the practical importance of the present invention, we might mention that in 1976 Western Europe, including Scandinavia, consumed about 260,000 metric tons of fluff pulp. During the same year the U.S.A. and Canada consumed together about 250,000 metric tons and Eastern Europe and the other transatlantic countries approx. 40,000–50,000 tons.

As has already been mentioned, fluff pulp is delivered in both bale and roll form. Rolls make up the major portion of the total consumption in Western Europe. In the U.S.A. and the other transatlantic countries rolls have about 95% of the market.

The market for sanitary products made of fluff pulp is growing very quickly. The penetration, i.e. the percentage of disposable diapers used in the total number of diaper changes, is expected to increase sharply in most countries. This is especially the case in the hospital sector in both Europe and in the U.S. For example, it can be mentioned that the penetration for the Nordic countries together (Sweden, Norway, Finland, and Denmark) in 1975 was about 77% and is expected to rise to 90% by 1985, while for the U.S. and Canada in 1975 it was about 45% and is expected to rise to about 85% by 1985.

Of the total consumption 1976, mechanical pulp accounted for a relatively small portion, but it is expanding. This share of the market has been achieved since the beginning of the 1970's when mechanical pulp for fluff purposes was introduced for the first time. In the U.S. and Canada almost no mechanical fluff pulp is used at present.

Mechanical pulp is gradually replacing the chemical pulp in diapers and cellulose wadding and so-called tissue in hospital underlays, due to comparable quality at a lower price.

Competition between converters of fluff pulp (diaper manufacturers for example) is quite stiff, giving rise to more efficient machines, factories and marketing organizations. Cheaper raw materials are becoming more and more important, thus favoring mechanical pulp.

As has already been mentioned, fluff pulp is used either in roll, bale or sheet form.

The following is comparative data on these pulp types and on the shredders used in connection therewith.

Roll Pulp

In dry defibration of roll pulp one usually uses a shredder of the hammer mill type which costs about $10,000–$15,000. This mill, which up to now has only been able to be used for roll pulp, gives the highest raw material cost for the fluff to the manufacturer. The price per ton of chemical roll pulp is at present about $500. Because of the simplicity and well-tested operation of this mill, this type is often selected as a shredder for new installations and in replacing old machines. The mill is used extensively throughout the entire world.

Another type of shredder for web fiber material, which is also used extensively, is the needle shredder.

Bale and Roll Pulp

A compromise between the shredders exclusively for webbed material and those exclusively for bales and sheets is the so-called B-fluffer (Kamas), which was mentioned above. With this it is possible to disintegrate bale pulp, but only mechanical fluff pulp, and mix it with chemical fluff pulp in roll form. The investment costs are immediately about six times as high (about $100,000/unit) as for the shredder for roll pulp exclusively. The technology is newer and more difficult to master. The operational costs are higher than for roll pulp. The advantage of this type of shredder is that one can use cheap mechanical bale pulp and, as desired, mix it with the more expensive chemical roll pulp. The high cost of the shredder is thus primarily a result of the option of defibrating bale pulp with the same. As was mentioned, the shredder for roll pulp is comparatively cheap and since mechanical fluff pulp also comes in roll form, the simple and cheap mill described for roll pulp should involve almost the same costs for raw materials as the much more technically advanced and more expensive B-fluffer.

It can be mentioned that chemical bale pulp is at present about $50/ton cheaper than chemical roll pulp.

In spite of the fact that one can use the least expensive raw material in a shredder of the type B-fluffer, that is to say mechanical bale pulp, it still has to be mixed with the most expensive pulp, that is to say chemical roll pulp. It would be a clear advantage if shredders solely for roll pulp could use sheet pulp instead. This problem is solved according to the present invention, which we will describe further on.

Bale and Sheet Pulp

Machines which can take care of both of these types of pulp at one time are on the market and include the system made by MoDo Mekan Mekanator. Such a machine makes it possible to manufacture fluff from the two cheapest types of pulp, namely mechanical pulp in bales and chemical pulp in sheets or bales. The investment costs, however, are 8–30 times as high as for the shredder for roll pulp alone. With an investment cost which is 8 times as high, two diaper machines can be coupled to a common shredder and with an investment cost which is 30 times as high, eight diaper machines can be coupled to the common shredder. In fluffing pulp in this type of machine, the whole bale is first chopped into strips in a guillotine, and the strips are then coarsely torn in a pin shredder. The coarse shredded fluff is conveyed to a storage tank and from this tank the fluff is fed out with screws for finished shredding at each individual diaper machine. It is thus necessary to have as many mills for fine shredding as there are diaper machines.

Summary

A comparison thus shows that roll pulp is expensive but the shredder for the same is comparatively inexpensive and dependable in operation. Bale and roll pulp in combination makes use of both the cheapest pulp (mechanical fluff pulp in bales) and the most expensive fluff pulp (chemical pulp in rolls), while the defibration device (B-fluffer) used is complicated and expensive and the operating costs are higher than for roll pulp alone. Finally, the combination of bale and sheet pulp involves the use of cheap raw materials but the investment in the shredder is very high.

It has now been demonstrated that according to the present invention, it is possible to achieve appreciable advantages—technical as well as economic—by using the advantages of all of the previously known and used systems for the manufacture of fluff pulp, by replacing the previous rolls with a bale in the form of a compressed, or not compressed, zig-zag folded continuous web. Advantages are enjoyed by both the pulp manufacturer and by the converter, the diaper manufacturer, for example. By virtue of the fact that the zig-zag folded fiber web according to the invention (called "Z-fluff pulp" in the following) has an estimated production cost which is about the same as the cheap bale and sheet pulp, but in any case less than that of the more expensive roll pulp, and since Z-fluff pulp can be defibrated in cheap roll pulp shredders already on the market, the present invention is a substantial and highly unexpected contribution to the art, obviating the need to buy and install bulky and costly defibration devices for cheap bale pulp. The alternative provided by the invention is the use of cheap Z-fluff pulp, defibrated in inexpensive shredders.

The fact that no one has, despite the very stiff competition within the sanitary products branch using fluff pulp, and despite the great advantages which the manufacture and use of Z-fluff pulp according to the invention provide (advantages described below), described or suggested up to now the use of fluff pulp in the form of a continuous, zig-zag folded web in a bale, demonstrates clearly that this solution was not obvious to the person skilled in the art.

Manufacturers of shredders have attempted to design machines which feed sheets one by one from a bale or stack, to take advantage of the low cost of sheet pulp over roll pulp, but they have had varying degrees of success.

The folding of web material into a zig-zag form within a stack or bale is known per se in other contexts. Swedish Pat. No. 222,271 (especially FIG. 5) describes how wadding can be produced and packaged in zig-zag form, and French Pat. No. 979,069 describes how a baby's diaper according to one embodiment can be manufactured with a replacable absorbant layer folded in a zig-zag configuration. However, the two patent specifications describe an entirely different material than according to the present invention, namely a material which has already been fluffed and is thus very soft. It is in no way obvious to the man skilled in the art to apply the teaching in the two patent specifications to the problem which is solved by the present invention. The fluff pulp, that is to say the dry, non-defibrated starting material for the fluff is a stiffer material, and it is natural to assume that such material could not be made in the form of a continuous folded web and be used in this form for feeding into a shredder in the manufacture of fluff for diapers, for example, since the situation was readily imaginable that when a crease is made such fiber breakage occurs in the crease that the web breaks when the web is unfolded and fed into the defibration device, with a break being expected first between the feeder rollers of the shredder and the defibration zone. If breakage occurs, a piece, possibly as long as 50 cm, is drawn into the shredder and can cause clogging of the shredder or cause irregularities in the weight of the products. The proclivity towards breakage which the crease itself has, is increased in the pressing operation. This last statement applies especially to folded mechanical fluff pulp, since mechanical pulp does not have the same soft fibers which chemical pulp has and has only half the percentage of long fibers as chemical pulp. Manual tensile tests confirmed the reduced strength in the crease of the mechanical pulp.

The present invention provides substantial advantages not only for the converter, i.e. the diaper manufacturer, but also for the manufacturer of fluff pulp. The folded pulp web in the form of a bale with the same material content as a normal roll, takes up only about 85% of the volume of the roll without taking into account the storage factors. Fluff pulp, in a roll, cannot be fully compressed as a bale of folded pulp can. It is important as regards transport economy and above all as regards function, when the folded web from the pulp bale is to be fed into a shredder, to have at least partial compression of the bale. The shape of the Z-fluff pulp bale and its compression achieves significant storage advantages, as well as other advantages. The simplicity of the roll is combined with the advantages of the bale. When manufacturing fluff pulp in roll form, a slitter-winder is used which cuts the rolls to the desired width. It is generally known to the person skilled in the art that if a single pulp strip breaks in the slitter-winder, the whole batch must be taken out. Due to this waste of material occurring in a stoppage, different peripheral speeds in the rolls result as a result of differing diameters. Splicing of the broken web is impossible. To avoid stoppage of the pulp producing machine as well, the entire width of the web is often rolled onto a reel-up drum and it is moved over to a slitter-winder for cutting into the correct widths. The advantage, according to the present invention, of using folding machines instead of reeling machines and slitters is that it is possible to work continuously and (1) without changing rolls/-bales; (2) if the web breaks the end is "self catching" and folding can be continued since there is no variation in peripheral speeds to contend with since there are no parallel rolls with different diameters on the same reel shaft.

The folded pulp (Z-fluff pulp) according to the invention means lower investment costs in comparison with roll pulp due to the fact that no device is needed for changing rolls and no slitter-winder is needed as a separate unit. Contributing to the lower manufacturing costs for Z-fluff pulp is the elimination of the costs for tubes for the rolls. Furthermore, the EUR pallet system can be used, which would not be economical for rolls.

If one takes for example a pulp plant which produces fluff pulp in sheet form and has a yearly production of 50,000 tons, which is transported by truck, and if we assume that they are presented with the choice of either purchasing a roll machine or a folder for the manufacture of Z-fluff according to the present invention, a rough calculation will show that the latter alternative with folded Z-fluff pulp involves a savings in transport costs and tube costs of about $1,000,000. Added to this is a savings in investment costs of about $100,000.

If we take a plant which already has a roll pulp system and wants to convert to Z-fluff pulp according to the present invention, direct savings are obtained according to the above alternatives. There is however an added investment of about $100,000 and the selling price for pulp should be able to be set lower approaching the price level for sheets.

For the converter, i.e. the diaper manufacturer or the like, the folded fluff pulp according to the invention provides the following advantages over roll pulp:

1. Price advantage. A normal consumption of fluff per conversion unit is about 1000 tons per year and involves a savings according to the above of ca. U.S. $40,000–50,000 per year.

2. Reduced storage space requirements. This can be a significant advantage since free space is needed for the bulky final product. The reduced storage space requirements for pulp bales in comparison to rolls, involves, of course, a direct saving.

3. Reduced and easier handling of the fluff pulp since the Z-fluff pulp according to a special embodiment of the present invention can be in the form of a continuous web, in several different bales. This advantage can never be achieved with roll pulp. Roll pulp requires a change of rolls every 20 minutes, while it is, in principle, possible to deliver a week's requirement of the folded pulp in one continuous web.

In summary, the folded Z-fluff pulp according to the invention provides the following advantages:

It can be used in defibration machines, which up to now had only been intended for roll pulp;

It takes up about 10% less space than the same number of meters of roll pulp;

It has a stowage factor of 1, since the pulp can always be fitted to EUR pallets;

It eliminates to a great extent the increase in transport costs involved in using mechanical pulp instead of chemical pulp in rolls. Thermomechanical fluff pulp in rolls is almost twice as bulky as chemical fluff pulp;

It is in principle a bale and its cost is about that of bales;

It provides the converter, the diaper manufacturer for example, with the same simple handling as the roll pulp;

It provides an opportunity for rationalization in the handling of raw materials for the converter, since it is possible to stack a whole day's supply in front of the band feeder;

It requires no rewinding as required in the manufacture of roll pulp where all the rolls are on a common spindle. The Z-fluff pulp can be folded in-line;

It requires no catching of the end when changing bales. Bale changing in the manufacture of bales is done at the bottom of the folded stack, where a steel wire for example is used to cut in a crease at the desired height;

It improves considerably the investment calculations for converter machines which work with expensive roll pulp.

The folding of the pulp web into a bale according to the invention can be done by relatively simple modifications of devices with are known per se or by means of more sophisticated devices. An especially suitable machine is being developed but it does not fall within the scope of the present invention. In the experiments described in the following Examples 1 and 2, the bales used were produced by folding a continuous pulp web from a roll pulp unit. Chemical fluff pulp in the form of a roll with diameter 80 cm and width 27 cm was folded into two bales with length of 85 cm, width of 27 cm and height of 65 cm (unpressed height). The folding was done in the form of a zig-zag so that it was possible to take the end of the uppermost layer and thus unfold the entire bale again. Each layer layed directly on top of the underlying layer. The unpressed folded bale was then placed in a bale press and was compressed. The height after compression was 51 cm. This means that the volume of the folded bale became $51 \times 8 \times 27 = 117{,}045$ $cm^3$, compared with that of the roll $$\frac{\pi \cdot 80^2}{4} \times 27 = 135{,}648 \text{ cm}^3.$$

Thus the folded pulp web in bale form with the same material content as a normal roll took up only about 86% of the volume of the roll without taking into account the stowage factor of the rolls. The bale of mechanical fluff pulp folded from rolls was also compressed. What was of primary interest in the experiments was the strength of the creases since it was conceivable that a hammer mill could tear off the web at the crease and pull with it a much too large piece of the pulp into the shredder. Of special interest was determining the crease strength of the thermomechanical pulp, which has significantly less crease strength than chemical pulp. It is worth noting in this context that the mechanical fluff pulp tested consisted of pure mechanical pulp and thus there was no mixing in of chemical fluff pulp, as occurs in the making of mechanical roll pulp. It was desired that the experiment be carried out under extreme conditions.

A B-fluffer of the type KAMAS was used as a shredder in the tests. As was previously mentioned, this machine is intended for chemical roll pulp and mechanical fluff pulp in bale form. To the B-fluffer there was connected a Model BDM-2 diaper machine from the company Dambi-Produkter.

Although the tests done show the production of fluff for making baby diapers, it is apparent to the person skilled in the art that the process according to the invention and the folded pulp web in bale form can be used just as advantageously in dry defibration of pulp for other purposes, for example in the manufacture of paper and paper-like products such as cartons and the like.

Various embodiments of the invention are conceivable, both for the manufacture of the Z-fluff pulp by the pulp manufacturer and for the use of the fluff by the converter. Thus according to one embodiment of the invention, the pulp web can be folded in a zig-zag manner into a bale with even distribution between the folds; i.e. each layer in the bale has the same length and extends out to the edge or side surface of the bale. This embodiment is shown in FIG. 1 in the drawing and is used in Examples 1 and 2.

However, it has been seen that when the pulp web is folded in this manner the bale or stack of folded layers increases rapidly in height at the sides where the folds are laid on top of one another (this is shown schematically in FIG. 2). This in turn has the result that the stack or pulp bale, after reaching its full desired height, is unmanagable because the top surface becomes excessively concave. The reason for this is of course that the folds formed are thicker than the pulp web directly adjacent. Pressing can, to a certain extent, remedy this, but not completely unless a very great pressure is used during operation, necessitating complicated equipment but still with the remaining risk of deformation of the pulp bales formed.

To avoid the above-mentioned disadvantages, it is possible according to a preferred embodiment of the invention to fold the pulp web staggering the creases so that every other crease has room between two creases lying farther out (FIG. 3). This means that an appreciably smaller pressing force is required to hold the pulp stack even in the upper layer and that the stack can be made higher, which is often desirable. The lower pressing force required is simpler to build into the system directly after the folding machine. The last-described method of folding the pulp web can of course be done with other staggering patterns between the creases, as shown in FIGS. 4 and 5, for example.

Instead of the pulp manufacturer delivering the folded pulp with a web width corresponding to the width which the customer (the converter) desires to feed into his defibration machine, according to a special and advantageous embodiment of the invention, the pulp manufacturer can produce the pulp web with a total width which is a multiple of the web width to be fed into the defibrator. The pulp web is folded across its entire width with the creases staggered as described above. Before folding, however, the broad pulp web is provided, by means of a suitable perforation device, with continuous "tear guides" along the entire length of the web, consisting of continuous rows of repeated cuts (perforations) and intermediate shorter non-cut sections. These tear guides are disposed at a desired predetermined spacing across the breadth of the web as shown in FIG. 6. In this way, the pulp web is divided into strips with the desired width, corresponding to the width which the converter desires to feed into his defibration machine. The strips are held together during and after being made, and above all during transport and storage, by the short intact bits along the perforation rows. When the defibration machine is fed, one or possibly more of the strips is torn off from the bale as shown in FIG. 10.

According to another embodiment of the invention, two strips are folded over one another along the tear guide row and it is fed into the defibration machine as a strip of double thickness. Even thicker strips, with triple thickness for example, are possible. The width of the strip fed in and its thickness are set as desired depending on the type of defibration machine used.

The invention will be described below with reference to the accompanying drawings.

The bale has already been described with reference to FIGS. 1–6.

The following is a more detailed description of the drawings.

Figure 1:
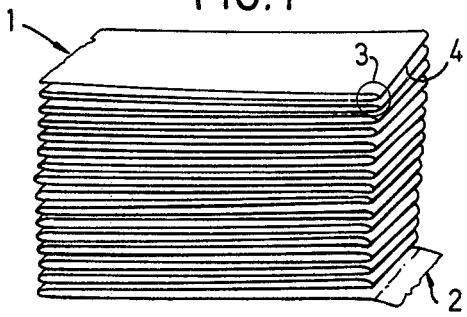
Figure 2:
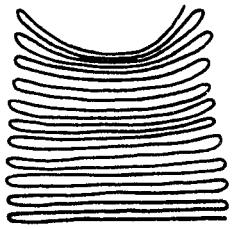

In FIG. 1, 1 indicates the beginning of the bale, 2 indicates the end of the bale, which can in principle continue up to the top of a new bale, and so on. 3 indicates the creases, and 4 shows where a rupture in the web can be expected to occur.

FIGS. 2–6 have already been discussed in detail.

Figure 7:
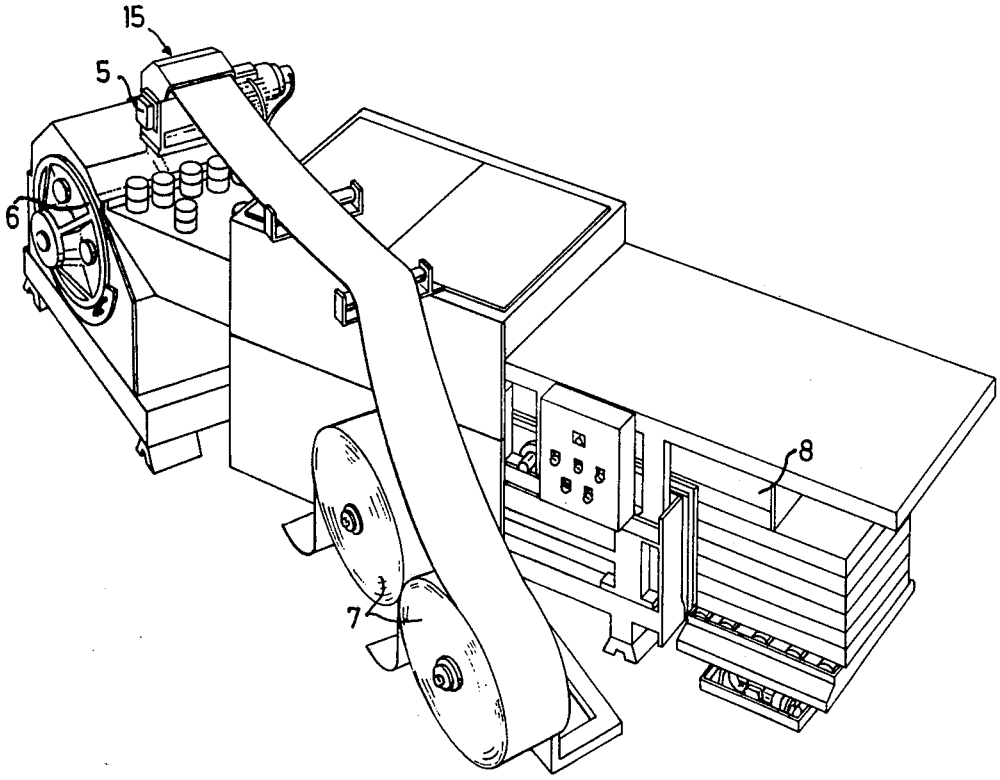
FIG. 7 PRIOR ART
FIG. 7 shows a sketch of a defibration machine used, Model KAMAS B-FLUFFER, with a roll pulp web connected according to the traditional process.

In FIG. 7, 5 indicates drive rollers for advancing the roll pulp. The protective covering over the rollers can be opened at 15. 6 indicates the defibration unit, 7 indicates the roll pulp stand and the roll pulp and 8 indicates the feed and hopper for mechanical fluff pulp in block/-slab form.

Figure 8:
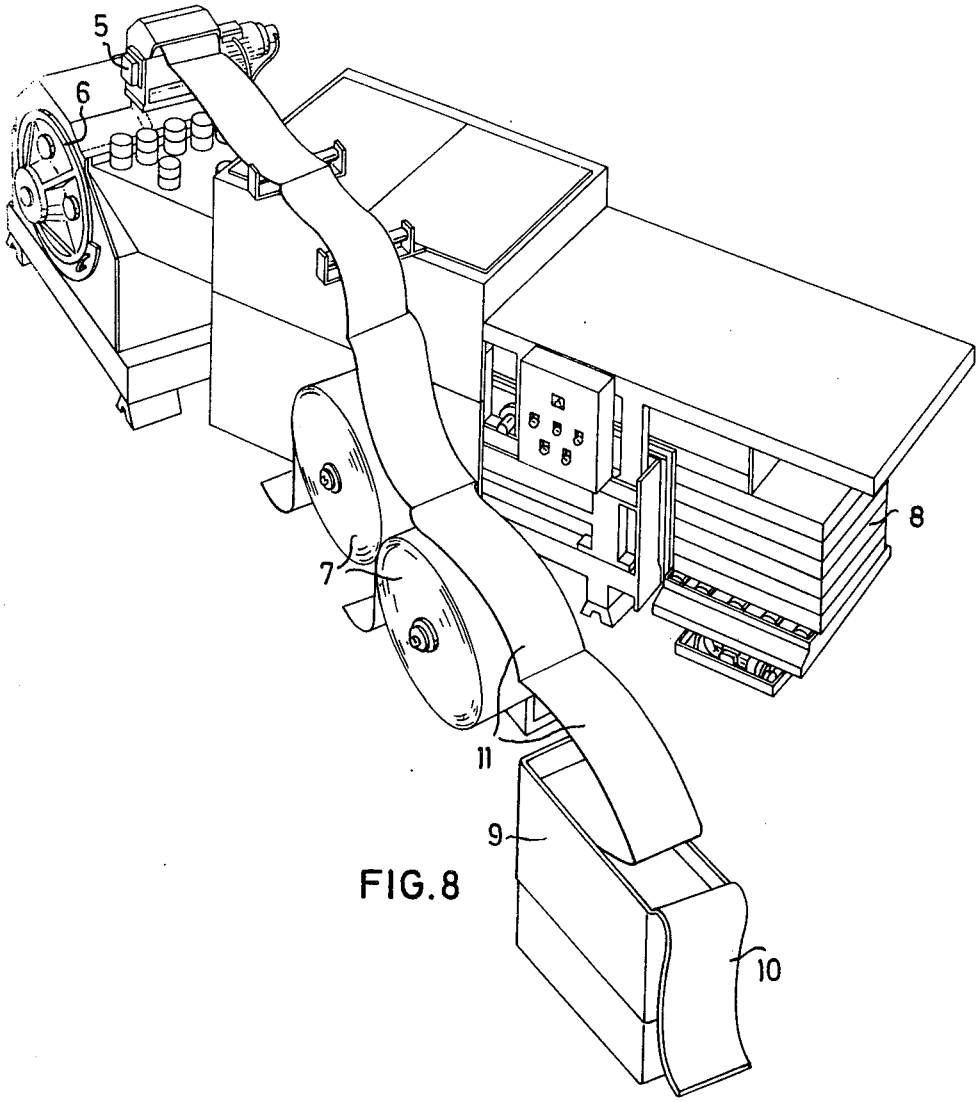
FIG. 8 shows the same machine as in FIG. 7, in which, however, the roll pulp has been disengaged and the Z-fluff web according to the invention has been coupled into the machine from a bale with single web width.

FIG. 8 shows an experiment with folded chemical fluff pulp according to the invention in combination with mechanical fluff pulp in blocks/slabs, in which 7 indicates the roll pulp disengaged, 9 indicates the bale of Z-fluff pulp, which according to a special embodiment is provided with a protective wrapping, 10 indicates the cut-off cover, 5 indicates the drive rollers for the Z-fluff pulp, 8 indicates the block pulp feed, and 11 indicates the individual Z-fluff pulp sections with a length of about 85 cm between the creases.

Figure 9:
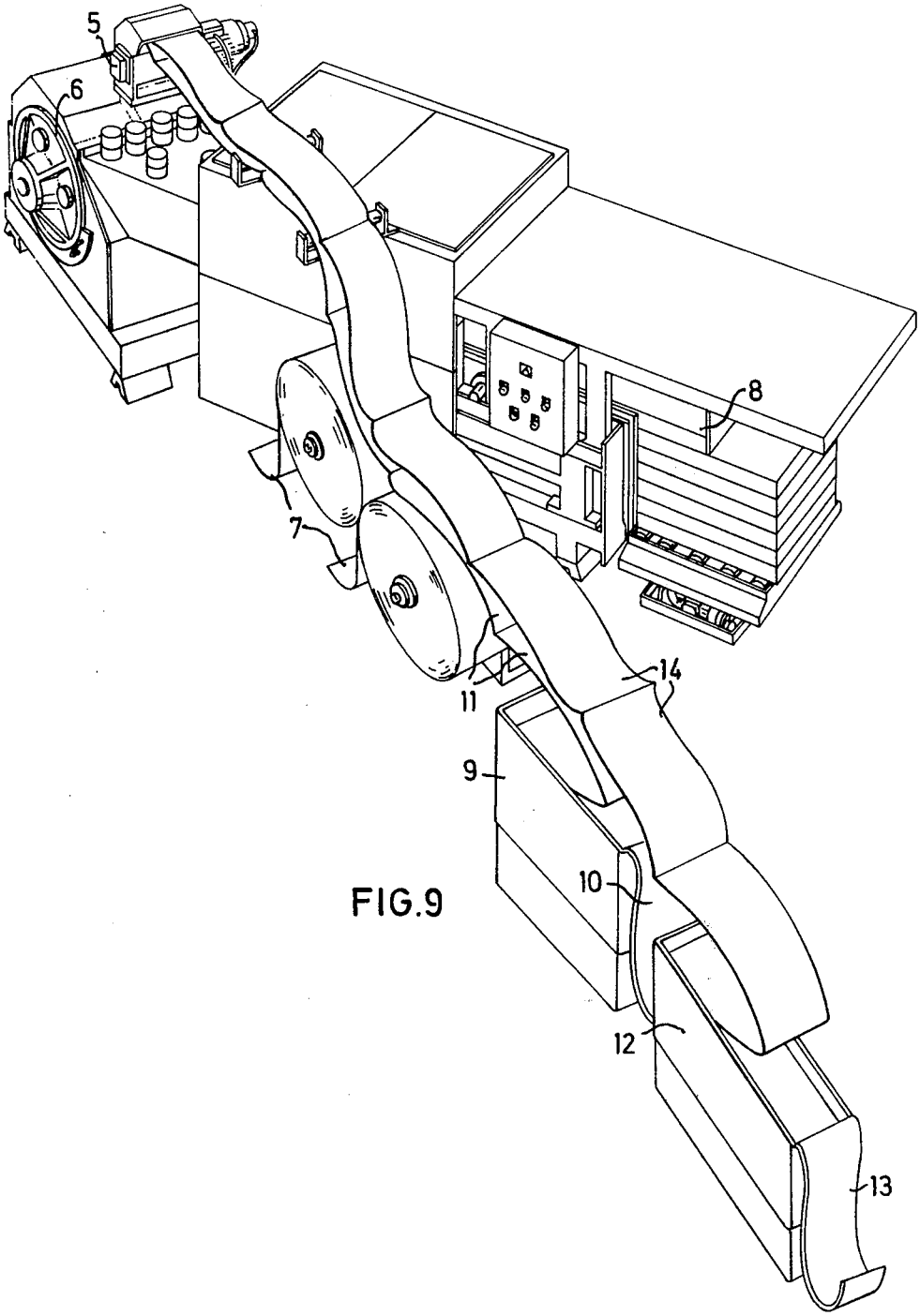
FIG. 9 shows the same defibration machine again in which the roll pulp has been disengaged and two types of folded pulp, i.e. mechanical Z-fluff pulp and chemical Z-fluff pulp, are fed into the shredder.

FIG. 9 shows another experiment with the use of chemical and mechanical Z-fluff pulp, wherein 7 indicates the roll pulp disengaged, 5 indicates the drive rollers for the Z-fluff pulp, 9 indicates a bale of chemical Z-fluff pulp (cellulose), 12 indicates a bale of mechanical Z-fluff pulp, 13 indicates the cut-off packaging cover of the bale, and 14 indicates the sections of Z-fluff pulp with lengths of about 85 cm.

Figure 10:
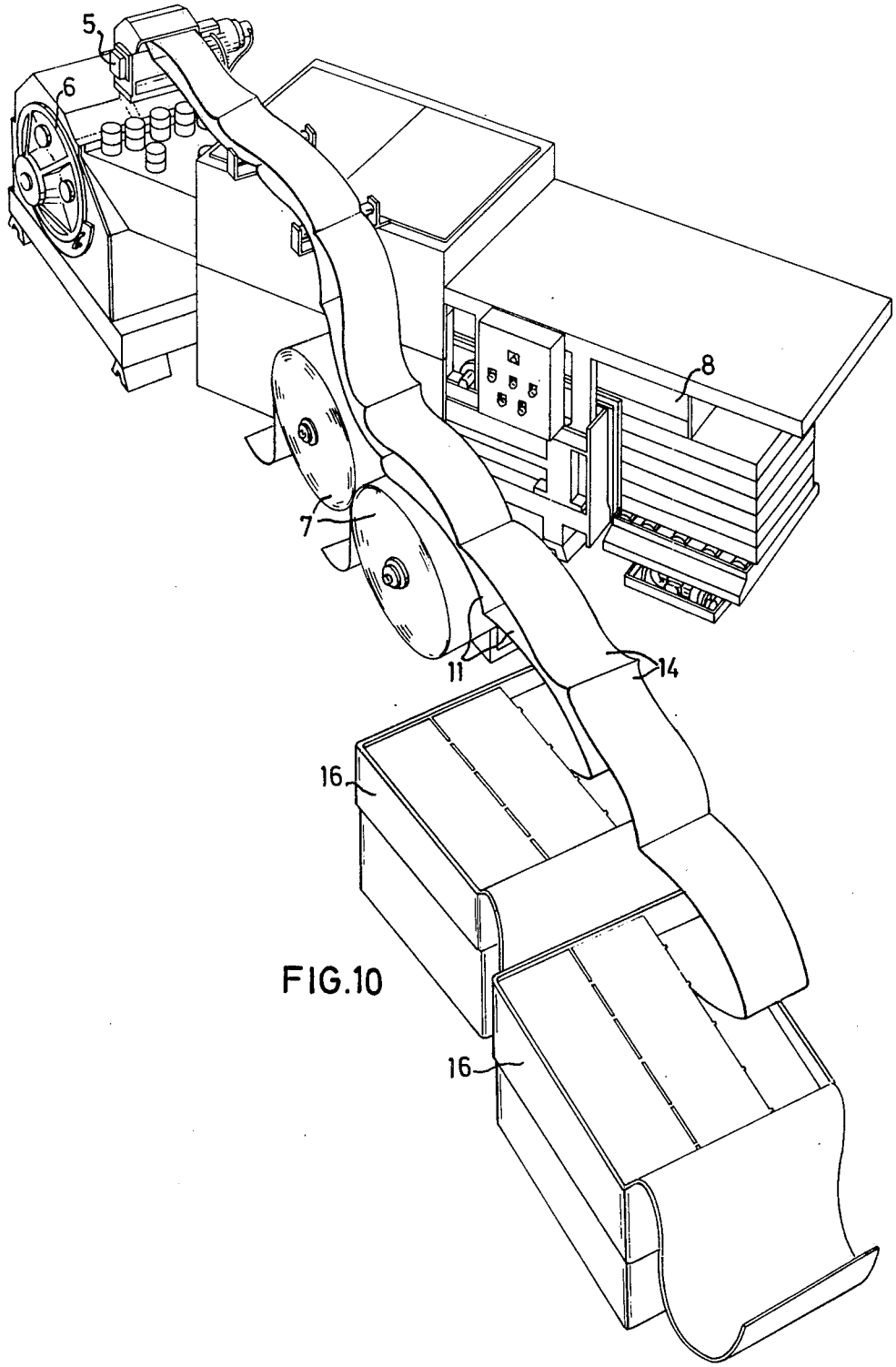
FIG. 10 shows, as has already been described briefly above, the advantageous embodiment of the invention according to which the bale of folded Z-fluff has a width which is a multiple of the feed width to the shredder, the single web widths being held together by a longitudinal perforation in the pulp web.

FIG. 10 shows in principle the same thing as FIG. 9 with the difference that the Z-fluff pulp in the two bales 16,17 has a triple web width, with one strip from each bale being torn off for feeding into the shredder.

EXAMPLE 1

This experiment was done as shown in FIG. 8. A mixture of 50% chemical Z-fluff pulp according to the invention and 50% mechanical fluff pulp in bale form were used. The web from the rolls was removed from the feeder rollers and chemical Z-fluff pulp from the bale was inserted instead. The shredder and the diaper machine were in operation when the switch was made. The bale 9 of chemical Z-fluff pulp was simply placed behind the roll stand as shown in the drawing. The wrapping was cut away from the top and the sides were kept as support. Of primary interest was finding out if the web would be torn off at the crease when it passed the drive rollers. The protective cover over the drive rollers 4 was opened and no tears occurred during the 10 minutes of the test. A total of about 40 kg chemical Z-fluff pulp was used during these 10 minutes, which means that 235 creases passed without any problems.

EXAMPLE 2

In this experiment which was carried out as illustrated in FIG. 9, the feed-in of blocks or slabs 8 was shut off entirely and a bale with mechanical Z-fluff pulp 12 was placed behind the bale with chemical Z-fluff 9 and the web of the mechanical Z-fluff pulp was fed between the drive rollers 5. In normal full scale production using the invention, there are of course no rolls, as in this experiment, placed as support for the Z-fluff pulp web. Rather, the Z-fluff pulp bales—several bales connected into a continuous web of each type of Z-fluff pulp—are stacked on pallets or directly on the floor for example, placed in sequence and closer to the shredder than in the present experiment. In the experiment it was the mechanical Z-fluff pulp which first came into contact with the shredding means of the machine and thus "took the brunt", but there occurred no tears in or at the creases and production proceeded completely normally. The experiment lasted about 10 minutes.

The two experiments showed that the expected tearing in the creases with accompanying production problems could be obviated with the aid of simple adjustments which would not pose any difficulties for the person skilled in the art in each individual case.

EXAMPLE 3

Figure 6:
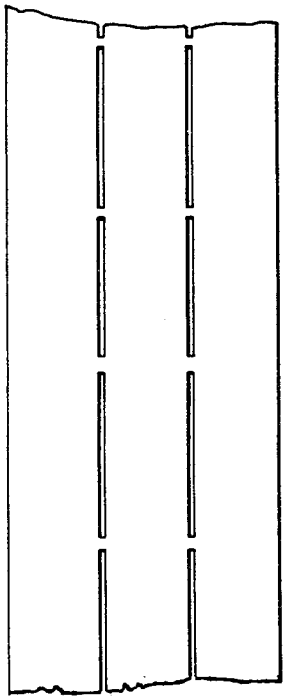

(A) A bale of chemical Z-fluff pulp was produced in which the width of the web was divided according to the perforating process shown in FIG. 6, so that strips were made with a width of 254 mm. The cut-through longitudinal sections of the perforation had a length of 450 mm and the intact sections, which had the function of holding the 254 mm wide strips together, had a length of about 1.5 mm. The cuts were made by a rotating perforating knife with a diameter of 150 mm, placed before the folding device and which cut against a roller of tempered steel.

The thickness of the pulp web was about 2 mm and the weight by unit of area was 850 g/m$^2$.

Figure 3:
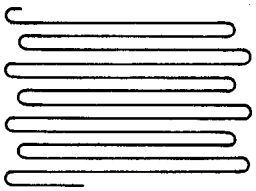
Figure 4:
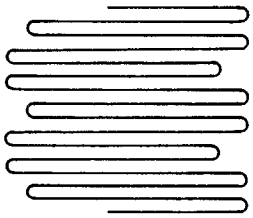
Figure 5:
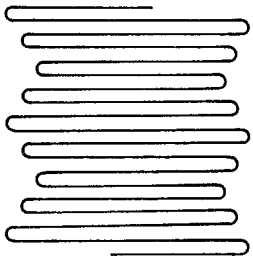

After perforation of the dried pulp web, it was fed to the folding device with a web speed of about 40 m/min. The folding of the web was done as shown in FIG. 3. To obtain a practically flat top surface on the final bale, after every three folds, the edges were pressed where the creases were. The edges were not compressed completely, only as much as was needed to obtain a somewhat flat surface.

(B) The bale produced according to (A) was used for the production of fluff. The bale was placed in front of a Mini-pad machine with Kamas hamer mill. The top end of the Z-fluff pulp strip with a width of 254 mm was pulled into the machine which was then started. The tearing-off of the strip from the rest of the bale proceeded without difficulty. The sections of the strip between each crease had a length of about 85 cm. When feeding into the shredder no negative effects of the creases could be observed. A feared jerky feeding-in of the strip upon unfolding of the creases from the bale, with subsequent defibration difficulties, was not forthcoming. The entire experiment was carried out without difficulty. The fluff obtained was of very high quality.

(C) A bale produced according to (A) was used in combination with a roll of somewhat softer chemical pulp for the production of fluff by means of a B-fluffer hammer mill. The roll with the somewhat softer pulp was placed behind the bale with Z-fluff pulp. The Z-fluff pulp web, when the double pulp web was fed into the shredder, was lying under the roll pulp web. The proces is shown in FIG. 10, if one imagines the bale 17 replaced by said roll. The tearing-off of the strip with a width of 254 mm from the rest of the bale and the feeding in of the double web proceeded without difficulty and the fluff obtained was of very high quality.

The experiment demonstrates how the Z-fluff pulp according to the invention can very well be combined with traditional roll pulp, and this can be of major interest to converters of fluff pulp, for example during a transition period to the more advantageous Z-fluff pulp.

What we claim is:

1. In a method for the dry defibration of fiber material in the form of fiber pulp to obtain fluff, comprising feeding the fiber pulp material into a comminuting or defibration device such as a hammer mill, pin mill, or similar device and discharging the comminuted material as exposed, unbonded fibers and fiber flocks; the improvement in which the form of the fiber pulp being fed into the defibration device is of a zig-zag-shaped repeatedly-folded continuous web of dry pulp.

2. Method according to claim 1, characterized in that the zig-zag-shaped repeatedly folded continuous web has staggered creases, i.e. varying lengths of the individual layers in the bale, the total width of the pulp web in the bale being divided by means of continuously repeated cuts and intermediate shorter non-cut sections along the entire length of the web into at least two joined strips with desired width for being fed to the shredder, so that on each occasion the advanced web is torn away from the rest of the bale with the desired width.

3. Method according to claim 1, characterized in that the continuous web is in the form of several joined bales of the same material, so that the tail end of the web in one bale is joined without a break to the starting end of the web in the following bale.

4. Method according to claim 1, characterized in that chemical fiber pulp and mechanical fiber pulp are fed from consecutively placed bales simultaneously to the defibration device.

5. Method according to claim 4, characterized in that the chemical fiber pulp and the mechanical fiber pulp each are present in the form of a continuous web, distributed over several joined bales.

6. Method according to claim 1, characterized in that the thickness of the pulp web is about 2 mm and the weight by unit of area is about 850 $g/m^2$.

* * * * *